US006435266B1

(12) United States Patent
Wu

(10) Patent No.: US 6,435,266 B1
(45) Date of Patent: Aug. 20, 2002

(54) HEAT-PIPE TYPE RADIATOR AND METHOD FOR PRODUCING THE SAME

(75) Inventor: Rex Wu, Tainan Hsien (TW)

(73) Assignee: AAVID Taiwan Inc. (TW)

( * ) Notice: Subject to any disclaimer, the term of this patent is extended or adjusted under 35 U.S.C. 154(b) by 0 days.

(21) Appl. No.: 09/873,225

(22) Filed: Jun. 5, 2001

(30) Foreign Application Priority Data

May 1, 2001 (TW) ..... 90110359

(51) Int. Cl.[7] ..... F28F 7/00
(52) U.S. Cl. ..... 165/80.3; 165/185; 29/890.032
(58) Field of Search ..... 165/80.3, 182, 165/183, 185, 104.33; 29/890.032, 890.046

(56) References Cited

U.S. PATENT DOCUMENTS 2,216,778 A * 10/1940 Houdry ..... 29/890.046
2,418,619 A * 4/1947 Brown, Jr. ..... 165/183
3,189,087 A * 6/1965 Parris ..... 165/182
3,216,095 A * 11/1965 Kurtz et al. ..... 29/890.046
3,543,069 A * 11/1970 Schmidt ..... 165/182
3,780,797 A * 12/1973 Gebelius ..... 165/182
4,928,756 A * 5/1990 Shull et al. ..... 165/182
5,509,645 A * 4/1996 Lai ..... 165/80.3
6,006,827 A * 12/1999 Lu ..... 165/182

* cited by examiner

*Primary Examiner*—Henry Bennett
*Assistant Examiner*—Terrell McKinnon
(74) *Attorney, Agent, or Firm*—Birch, Stewart, Kolasch & Birch, LLP

(57) ABSTRACT

A heat-pipe type radiator includes a plurality of fins closely arranged side to side and correspondingly provided with at least one first hole, and at least one heat pipe extended through the fins via the at least one hole provided on each fin. Each hole on the fin is provided at an edge with a second hole. A bonding agent is applied via the second holes into the first holes to fill up a clearance in the first holes between the heat pipe and the fins. In this type of radiator, an entire circumferential surface of the heat pipe is in contact with the fins to enable enhanced heat transfer from the heat pipe to the fins. In a method of producing the above-described heat-pipe type radiator, the bonding agent may be a solder paste or a solder stick depending on a shape of the second hole and is heated to a melting point to flow from the second holes into the first holes. After the molten bonding agent is cooled and set, it firmly bonds the heat pipe and the fins together.

22 Claims, 6 Drawing Sheets

HEAT-PIPE TYPE RADIATOR AND METHOD FOR PRODUCING THE SAME

BACKGROUND OF THE INVENTION

The present invention relates to a heat-pipe type radiator and a method for producing such radiator, and more particularly to a radiator, of which a heat pipe has an entire circumferential surface in contact with a plurality of closely arranged fins to enable enhanced radiating effect.

While various kinds of electronic elements, such as chips, microprocessors, etc., have been widely employed in the quickly developed electronic apparatus, they face a common problem of highly increased working temperature. To solve this problem, the provision of heat exchangers to effectively radiate heat produced by the electronic elements during working has now become a very important and requisite means.

There is a conventional heat exchanger that includes fins made of extruded aluminum. That is, such type of conventional heat exchanger uses fins that are separately formed from a whole piece of aluminum material at very high cost, making the heat exchanger less competitive in the market. Attempts have been made to replace the above-mentioned conventional heat exchanger using integral aluminum fins with a heat-pipe type radiator that is supposed to have a reduced cost. FIG. 1 is a fragmentary perspective view of this conventional heat-pipe type radiator, and FIG. 2 is a fragmentary sectioned side view thereof. As can be seen from the drawings, the conventional heat-pipe type radiator mainly includes a plurality of fins 1 and two heat pipes 2. Each of the fins 1 is an elongated strip with two longitudinal edges thereof bent in the same direction to form two flanges 11. The fin 1 is then punched to provide two spaced truncated conical collars 12, each of which is tapered from a root toward a free end thereof. Each of the heat pipes 2 is a long round bar being extended through the fins 1 via the collars 12 to locate in the collars 12 in the manner of interference fit.

With the above arrangements, there is a circumferential line contact between each heat pipe 2 and each truncated conical collar 12, enabling heat to transfer from the heat pipes 2 to the fins 1 at where the heat is radiated.

The above-described conventional heat-pipe type radiator has the following disadvantages:

1. The heat pipes 2 and the fins 1 are connected to each other through interference fit. That is, each heat pipe 2 is forced through the conical collars 12 that have an inner diameter smaller than an outer diameter of the heat pipe 2, so that the heat pipe 2 is tightly connected to the fins 1 at the conical collars 12. However, the conical collars 12 are expanded when the heat pipe 2 is forced therethrough, making the fins 1 slidable along the heat pipe 2. Under this condition, at least two heat pipes 2 are needed to firmly hold the fins 1 on the heat pipes 2. That is, the conventional heat-pipe type radiator still requires considerably high cost for material.
2. The provision of interference fit is to allow a tight connection of the heat pipe 2 to the fins 1. However, the heat pipe 2 and each fin 1 in this conventional design contact with one another only at a circumferential line or even only at some points spaced along the circumferential surface of the heat pipe 2. Thus, heat is not effectively transferred from the heat pipes 2 to the fins 1 at all.
3. The forcing of the heat pipes 2 through the conical collars 12 could not be done manually. Specially designed machines are needed for this operation.

It is therefore tried by the inventor to develop an improved heat-pipe type radiator and a method for producing the same, so that the radiator could be produced at reduced cost to effectively provide enhanced radiating effect.

SUMMARY OF THE INVENTION

A primary object of the present invention is to provide a heat-pipe type radiator including a plurality of closely arranged fins that are correspondingly provided with at least one first hole having a second hole provided at an edge thereof, at least one heat pipe that is extended through the first holes on the fins, and a bonding agent that fills a clearance in the first holes between the heat pipe and the fins to firmly bond the heat pipe and the fins together, so that a surface contact exists between them, allowing heat to more quickly transfer from the heat pipe to the fins.

Another object of the present invention is to provide a method of producing the above-mentioned heat-pipe type radiator having enhanced radiating effect. The method includes the following steps: (a) preparing at least one heat pipe; (b) providing a plurality of fins that are closely arranged side to side and are correspondingly provided at a predetermined position with at least one first hole sized for the at least one heat pipe to extend therethrough and locate therein, and each first hole being provided at an edge at a predetermined position with a second hole; (c) preparing a predetermined bonding agent; (d) extending the at least one heat pipe through the at least one first hole to form a primary assembly of the heat pipe and the fins, and filling the bonding agent into the second holes; (e) heating the bonding agent to its melting point, so that the bonding agent melts and flows from the second holes into the first holes to fill up a clearance in the first holes between the heat pipe and the fins; and (f) allowing the bonding agent in a molten form in the first holes to cool and set, so as to tightly bond the at least one heat pipe to the fins to complete the heat-pipe type radiator.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
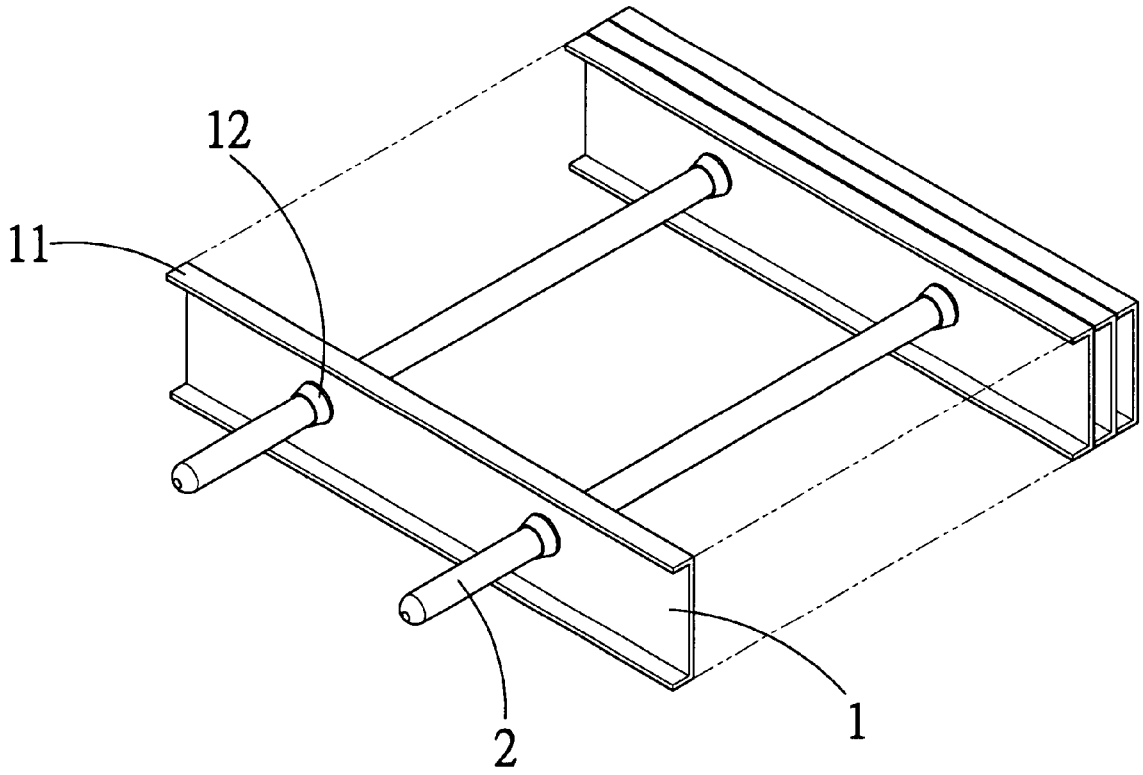
PRIOR ART Fig.1
FIG. 1 is a fragmentary perspective view of a conventional heat-pipe type radiator.
Figure 2:
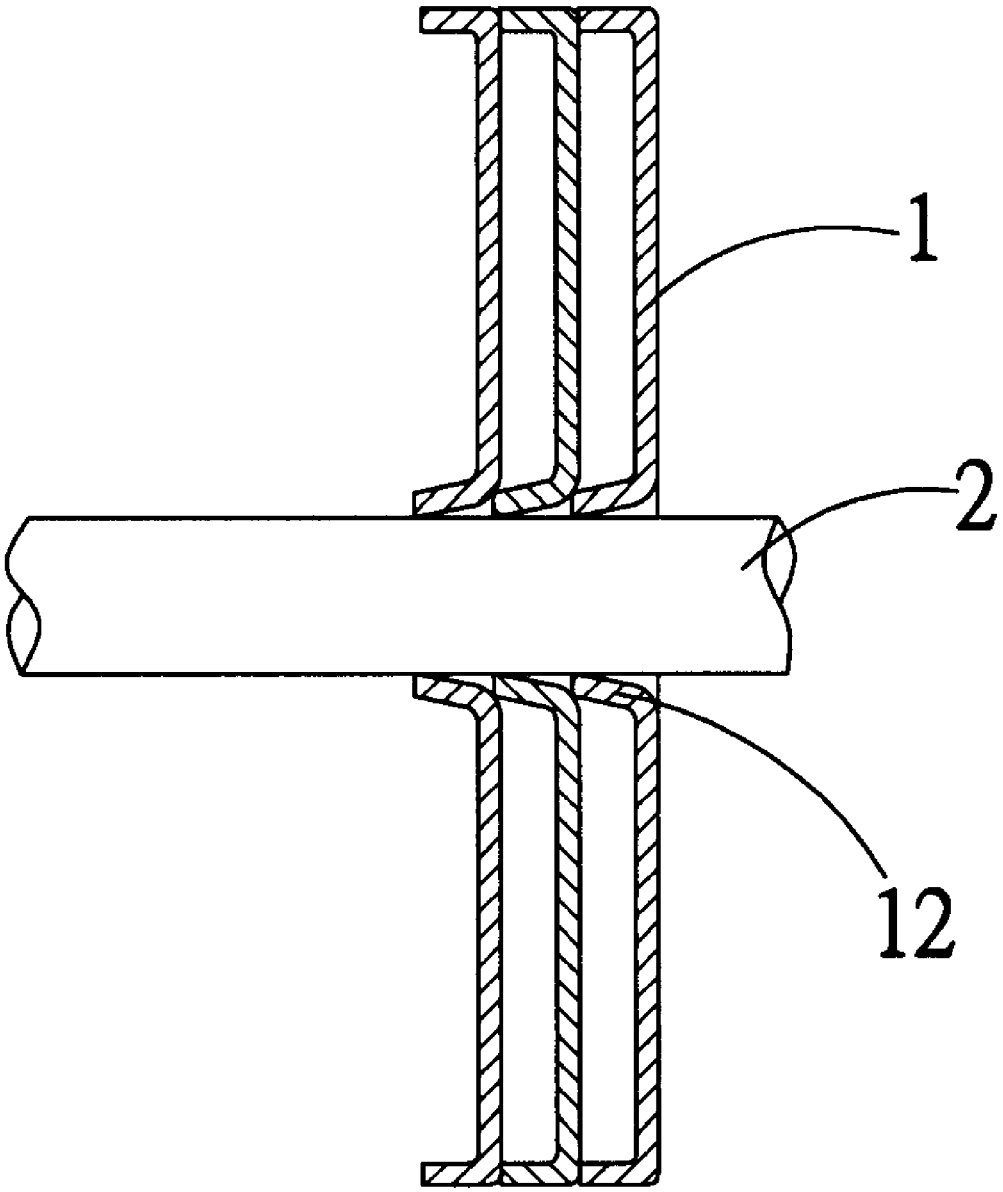
PRIOR ART Fig.2
FIG. 2 is a fragmentary sectioned side view of FIG. 1.
Figure 3:
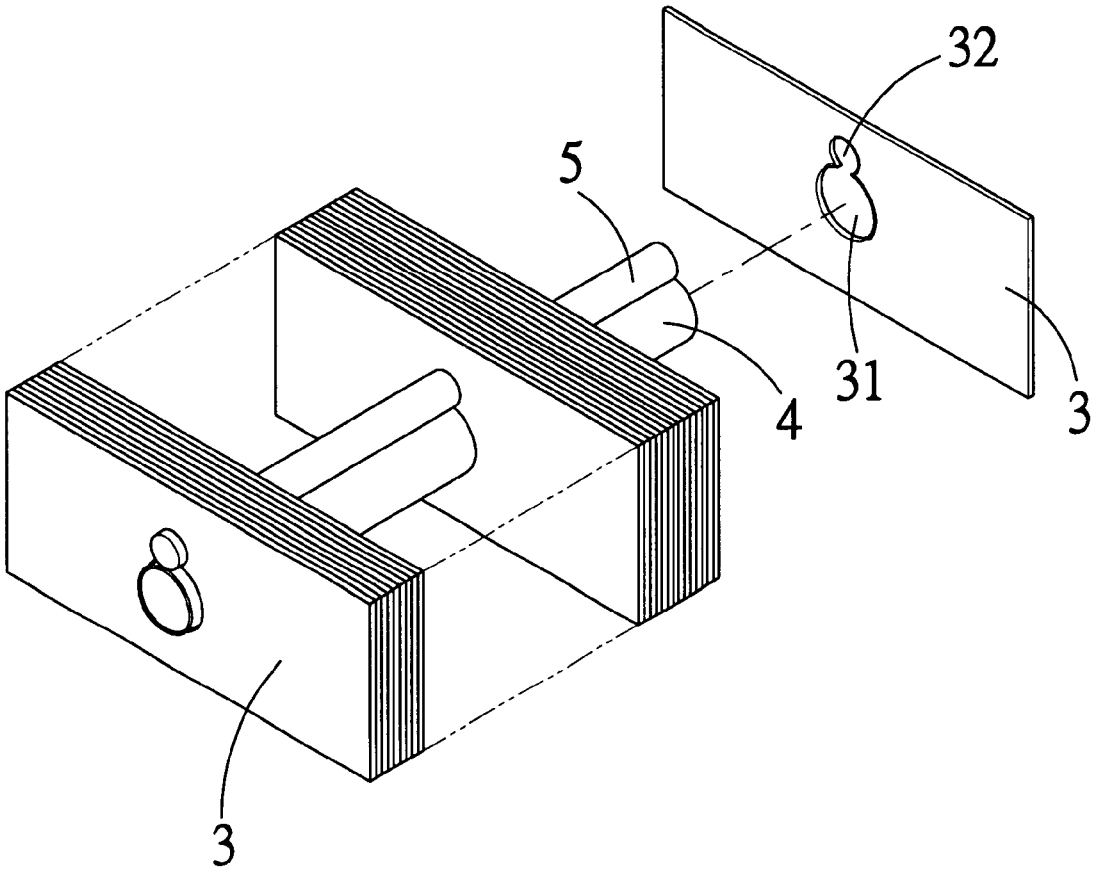
FIG. 3 is a partially exploded perspective view showing the producing of a heat-pipe type radiator according to a first embodiment of the present invention.
Figure 4:
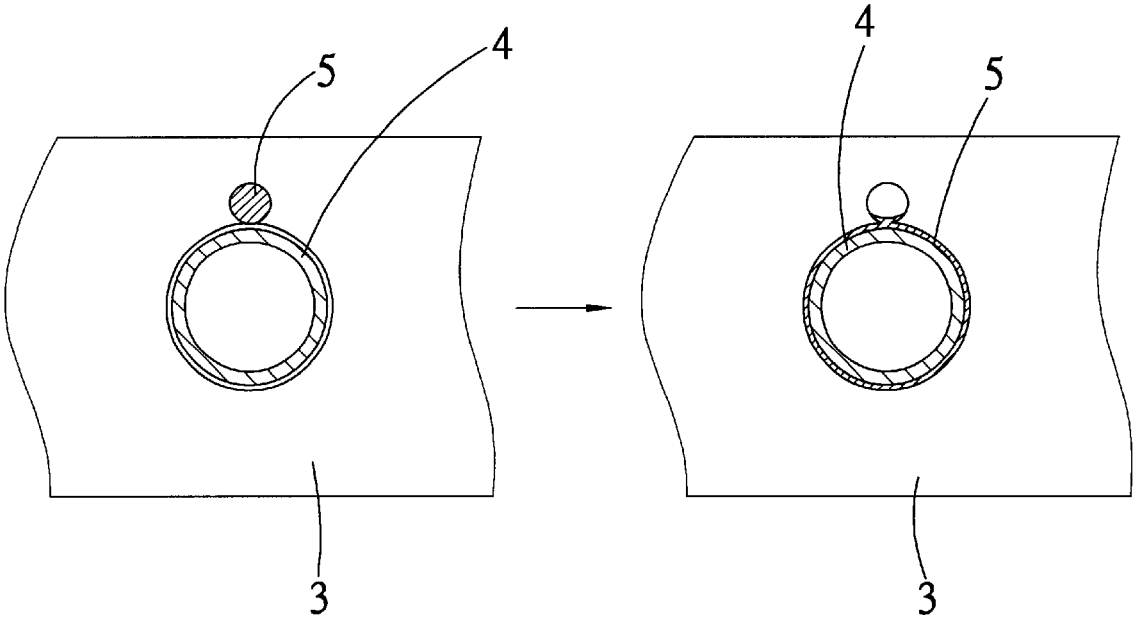
FIG. 4 is a fragmentary cross sectional view showing the bonding of a heat pipe to fins of the radiator of FIG. 3 with a bonding agent.

Please refer to FIGS. 3 and 4 in which a heat-pipe type radiator according to a first embodiment of the present invention is shown. As shown, the radiator mainly includes a plurality of fins 3, a heat pipe 4, and a predetermined type of bonding agent 5.

The fins 3 are closely arranged side to side. All the fins 3 are correspondingly provided at a predetermined position with a first hole 31 and above the first hole 31 with a second hole 32. The second hole 32 is smaller than and partially connected to the first hole 31, so that the first and the second holes 31, 32 are communicable with each other. In the illustrated drawings, each fin 3 is provided with a first and a second hole 31, 32 and these two holes are round in shape. However, it is understood the numbers of the first and the second holes 31, 32 may be two or more, and the first and the second holes 31, 32 are not necessarily round holes.

The heat pipe 4 has a cross section in a shape corresponding to that of the first hole 31, so that the heat pipe 4 may be extended through the first holes 31 of the closely arranged fins 3 to locate therein.

The bonding agent 5 is a solder stick having a size suitable for extending through the second holes 32 of the closely arranged fins 3 to locate therein. The solder stick 5 in the second holes 32 is heated to a melting point so as to flow into the first holes 31 and fill a clearance between the heat pipe 4 and all fins 3 (see FIG. 4) to firmly bond the heat pipe 4 to the fins 3 and form a heat-pipe type radiator of the present invention.

Figure 5:
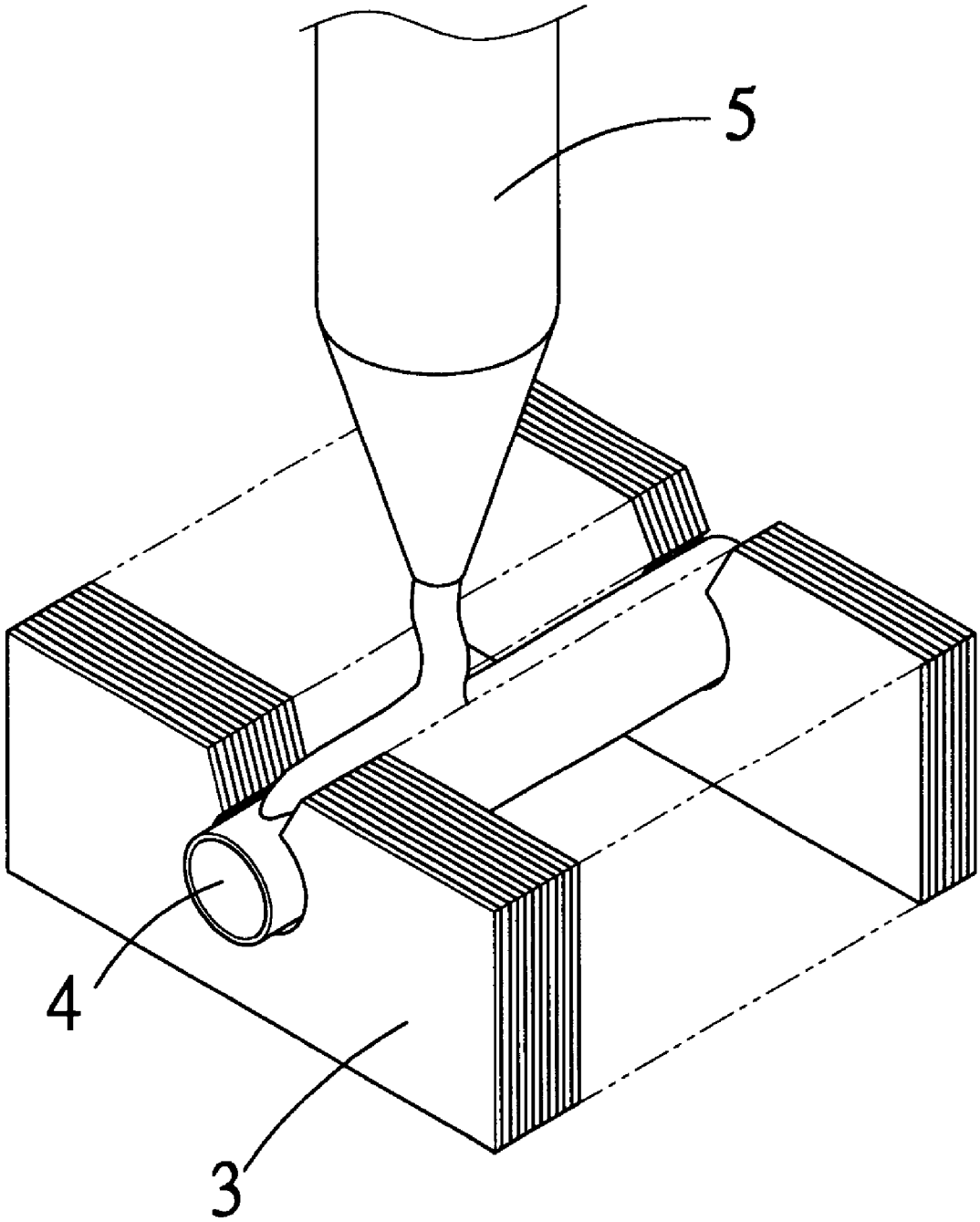
FIG. 5 is a fragmentary perspective view showing the producing of a heat-pipe type radiator according to a second embodiment of the present invention.
Figure 6:
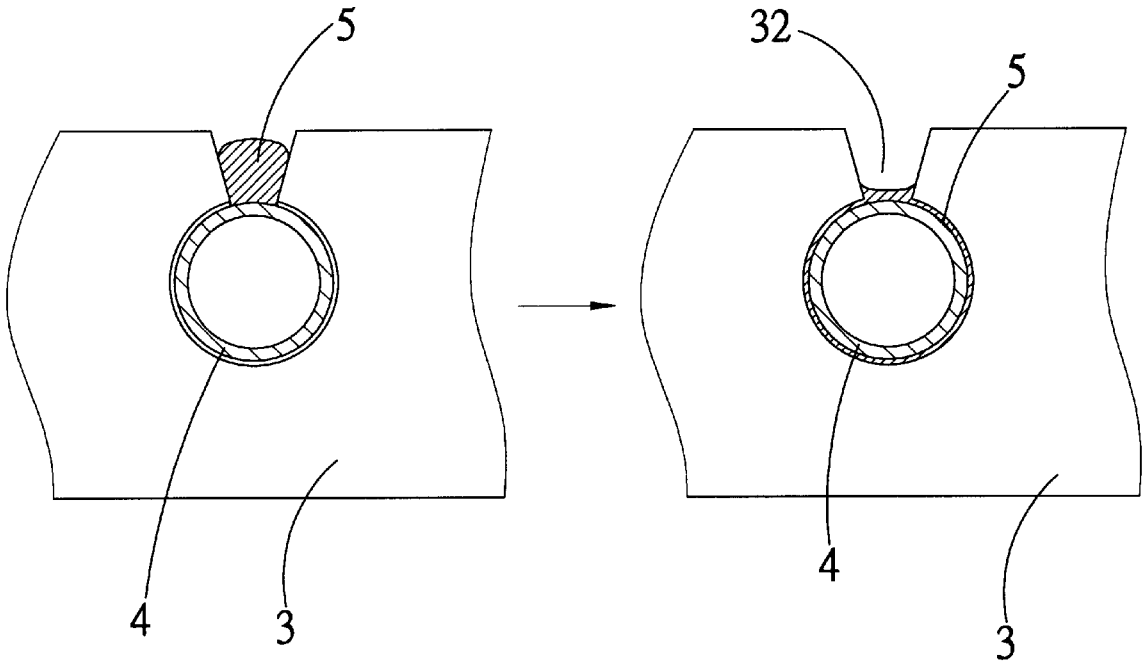
FIG. 6 is a fragmentary cross sectional view showing the bonding of a heat pipe to fins of the radiator of FIG. 5 with a bond agent.

Please refer to FIGS. 5 and 6 in which a second embodiment of the present invention is shown. This second embodiment is generally similar to the first embodiment, except that the second hole 32 is replaced with a substantially funnel-shaped cut 32. The cut 32 has a wide upper opening provided at a top edge of the fin 3 and a narrow lower opening provided at a top portion of the first hole 31 to communicate the cut 32 with the first hole 31. In this case, the bonding agent 5 used to fill the clearance between the heat pipe 4 and the fins 3 is a solder paste 5 adapted to directly apply into the cuts 32 via the wide upper openings thereof (see FIG. 5).

The present invention also provides a method to produce the above-described heat-pipe type radiator. The method includes the following steps:

a. Preparing at least one heat pipe 4;

b. Providing a plurality of fins 3 that are closely arranged side to side and are correspondingly provided at a predetermined position with at least one first hole 31 sized for the heat pipe 4 to easily extend therethrough and to locate therein, and at a position above each first hole 31 with at least one second hole 32 to communicate with the first hole 31, and the first and the second holes 31, 32 may be of any shape; or alternatively, the second hole 32 may be replaced with a funnel-shaped cut 32 with a wide upper opening thereof provided at a top edge of the fin 3 and a narrow lower opening thereof provided at a top portion of the first hole 31 to communicate the cut 32 with the first hole 31;

c. Preparing at least one solder stick as the bonding agent 5 in the case a second hole 32 is provided above each first hole 31; or preparing a solder paste as the bonding agent 5 in the case a funnel-shaped cut 32 is provided above each first hole 32;

d. Extending the at least one heat pipe 4 through the first holes 31 to form a primary assembly of the heat pipe and fins, and filling the at least one second hole 32 or the at least one funnel-shaped cut 32 with at least one solder stick or the solder paste, respectively;

e. Heating the bonding agent 5, either in the form of solder stick or solder paste, to its melting point, so that the molten bonding agent 5 (that is, the molten tin) flows from the second holes or the funnel-shaped cuts 32 down into the first holes 31 to fill up a clearance in each first hole 31 between the heat pipe 4 and the fin 3; and f. Allowing the molten bonding agent 5 to cool and set, so as to tightly bond the heat pipe 4 to the fins 3 to complete a heat-pipe type radiator of the present invention.

In the above step "e", the bonding agent 5 is heated by using a hot air gun (not shown) to blow hot air toward the bonding agent 5. Alternatively, the primary assembly of the fins 3 and the at least one heat pipe 4 with the bonding agent 5 applied thereto is sent into a furnace (not shown) to melt the bonding agent 5.

The following are some of the advantages of the heat-pipe type radiator and the method for producing it according to the present invention:

1. Before the bonding agent 5 is molten, the heat pipe 4 and the fins 3 are connected to one another through clearance fit. That is, the heat pipe 4 has a cross section smaller than that of the first holes 31, so that a clearance exists between the heat pipe 4 and the first holes 31 when the heat pipe 4 is located in the first holes 31. When the molten tin 5 filling the clearance has become cooled and set, the heat pipe 4 is bonded to all fins 3. In this way, a largely reduced cost for assembling the heat pipe and the fins is possible to make the product competitive in the market.
2. The contact between the heat pipe 4 and the fins 3 fully bonded together by the molten tin 5 is a surface contact that enables quick transfer of heat from the heat pipe 4 to the fins 3 to obtain enhanced radiation effect.
3. With the clearance fit designed for the heat pipe 4 and the fins 3, the heat pipe 4 could be easily extended through the first holes 31 on the fins 3. Similarly, the bonding agent 5, either in the form of solder stick or solder paste, could also be easily disposed into the second holes or the funnel-shaped cuts 32 on the fins 3 due to the clearance fit designed for them. The bonding agent 5 could then be molten with a hot air gun or by sending the primarily assembled radiator into a furnace simply by an operator without the need of any complicate equipment. Costs for complicate equipment can therefore be saved.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A heat-pipe type radiator, comprising:

a plurality of fins being closely arranged side to side and correspondingly provided at a predetermined position with at least one first hole, and each said first hole being provided at an edge at a predetermined position with a second hole;

at least one heat pipe being extended through said first holes on said fins; and a bonding agent that melts and flows from said second hole into said first hole to fill a clearance in said first holes between said at least one heat pipe and said fins to bond said at least one heat pipe to said fins.

2. The heat-pipe type radiator as claimed in claim 1, wherein said at least one first hole is a round hole.

3. The heat-pipe type radiator as claimed in claim 1, wherein each of said fins is provided with two said first holes.

4. The heat-pipe type radiator as claimed in claim 1, wherein said second hole is a round hole.

5. The heat-pipe type radiator as claimed in claim 1, wherein said second hole is a funnel-shaped cut.

6. The heat-pipe type radiator as claimed in claim 1, wherein said second hole is provided at an upper edge of each said first hole and has an open top provided at an upper edge of each said fin.

7. The heat-pipe type radiator as claimed in claim 1, wherein each of said fins has two said second holes.

8. The heat-pipe type radiator as claimed in claim 1, wherein said at least one heat pipe has a sectioned shape corresponding to and smaller than that of said at least one first hole, and said at least one heat pipe being located in said at least one first hole in the manner of clearance fit.

9. The heat-pipe type radiator as claimed in claim 1, wherein said bonding agent is in the form of a solder stick.

10. The heat-pipe type radiator as claimed in claim 1, wherein said bonding agent is in the form of a solder paste.

11. A method of producing a heat-pipe type radiator, comprising steps of:

a. Preparing at least one heat pipe;

b. Providing a plurality of fins that are closely arranged side to side and are correspondingly provided at a predetermined position with at least one first hole sized for said at least one heat pipe to extend therethrough and locate therein, and each said first hole being provided at an edge at a predetermined position with a second hole;

c. Preparing a bonding agent;

d. Extending said at least one heat pipe through said at least one first hole on each of said fins to form a primary assembly of said heat pipe and said fins, and filling said bonding agent into each said second hole;

e. Heating said bonding agent to its melting point, so that said bonding agent melts and flows from said second holes into said first holes to fill up a clearance in said first holes between said heat pipe and said fins; and f. Allowing said bonding agent in a molten form in said first holes to cool and set, so as to tightly bond said at least one heat pipe to said fins to complete said heat-pipe type radiator.

12. The method of producing a heat-pipe type radiator as claimed in claim 11, wherein said at least one first hole is a round hole.

13. The method of producing a heat-pipe type radiator as claimed in claim 11, wherein each of said fins has two said first holes.

14. The method of producing a heat-pipe type radiator as claimed in claim 11, wherein said second hole is a round hole.

15. The method of producing a heat-pipe type radiator as claimed in claim 11, wherein said second hole is a funnel-shaped cut.

16. The method of producing a heat-pipe type radiator as claimed in claim 11, wherein each of said fins has two said second holes.

17. The method of producing a heat-pipe type radiator as claimed in claim 11, wherein said second hole is provided at an upper edge of each said first hole and has an open top provided at an upper edge of each said fin.

18. The method of producing a heat-pipe type radiator as claimed in claim 11, wherein said at least one heat pipe has a sectioned shape corresponding to and smaller than that of said at least one first hole, and said at least one heat pipe being located in said at least one first hole in the manner of clearance fit.

19. The method of producing a heat-pipe type radiator as claimed in claim 11, wherein said bonding agent is in the form of a solder stick being extended through said second holes to locate therein.

20. The method of producing a heat-pipe type radiator as claimed in claim 11, wherein said bonding agent is in the form of a solder paste being applied into said second holes.

21. The method of producing a heat-pipe type radiator as claimed in claim 11, wherein said bonding agent is heated by using a hot air gun to blow hot air toward said second holes.

22. The method of producing a heat-pipe type radiator as claimed in claim 11, wherein said bonding agent is heated by sending said primary assembly of said at least one heat pipe and said fins having said bonding agent filled in said second holes into a furnace to heat and melt said bonding agent.

* * * * *